United States Patent [19]

Nieman et al.

[11] 4,163,827

[45] Aug. 7, 1979

[54] METHOD OF MAKING A WRAPPED INNOCULATION ROD SUITABLE FOR MODIFYING THE COMPOSITION OF MOLTEN METALS

[75] Inventors: John R. Nieman; S. David Sanders, both of Pekin, Ill.

[73] Assignee: Caterpillar Tractor Co., Peoria, Ill.

[21] Appl. No.: 871,722

[22] Filed: Jan. 23, 1978

[51] Int. Cl.[2] ..... B31C 13/00; B65H 81/06; B65H 81/08; C22C 33/00

[52] U.S. Cl. ..... 428/377; 75/123 L; 75/130 R; 156/184; 156/185; 164/57; 264/176 R; 428/385

[58] Field of Search ..... 428/377, 385; 156/185, 156/184; 164/57, 59; 75/123 L, 130 R; 264/176 R

[56] References Cited

U.S. PATENT DOCUMENTS

| | | | |
|---|---|---|---|
| 1,441,686 | 1/1923 | Jones | 428/377 |
| 1,586,862 | 6/1926 | Ten Eyck | 428/377 |
| 1,863,772 | 6/1932 | Turner | 428/377 |
| 1,980,890 | 11/1934 | Tompkins | 428/385 |
| 1,993,838 | 3/1935 | Hagedorn | 428/377 |
| 2,000,182 | 5/1935 | Lincoln | 428/385 |
| 2,060,681 | 11/1936 | Miller et al. | 428/385 |
| 2,179,965 | 11/1939 | Strube | 428/377 |
| 2,231,247 | 2/1941 | Bleakley | 428/385 |
| 3,118,760 | 1/1964 | Avery et al. | 428/385 |
| 3,921,700 | 11/1975 | Frantzreb et al. | 164/57 |

*Primary Examiner*—J. C. Cannon

*Attorney, Agent, or Firm*—Charles E. Lanchantin, Jr.

[57] ABSTRACT

A method of making a filled tubular article for controlled insertion into a molten metal includes extruding a treating material through an apparatus to form an elongated core element and wrapping the core element in a protective casing. Preferably, the casing of the article includes a helically wrapped ribbon-like strip.

9 Claims, 4 Drawing Figures

METHOD OF MAKING A WRAPPED INNOCULATION ROD SUITABLE FOR MODIFYING THE COMPOSITION OF MOLTEN METALS

BACKGROUND OF THE INVENTION

The present invention relates to a method of making a filled tubular article for controlled insertion into a molten metal as it is being cast, and to the article made thereby.

The addition of alloying and treating agents into a molten metal such as iron, by insertion of an elongated rod-like article into a casting mold's downsprue is becoming more well known in the art. More sophisticated methods and apparatuses have recently been developed to controllably insert filled tubular articles into the casting molds during metal pouring at exactly the rate and point required to obtain the desired castings. These elongated articles usually have a core of powdered ingredients or particulate material carried in a protecting tube. As far as is known, such articles are manufactured by depositing the powdered ingredients onto a strip of metal that may be partly formed into a trough. The strip is thereafter formed into a tube by conventional methods with the edges either abutting or overlapping. Unfortunately, a major problem is experienced at this point because the ingredients of the core are not sufficiently densified within the tube which results in the powder tending to separate and move within the tube. Consequently, it has been found necessary to pass the tube axially through a forming die which reduces its external diameter and compacts the powdered ingredients. Even with this extra step it is a frequent practice to crimp or pinch the ends of the tubes to keep the particulate material from falling out. Such crimping practice is also used for retaining powder in an alternate construction embodying short stiff tubes which are filled with powder after the tubes are made.

Not only are the aforementioned manufacturing procedures for making the filled tubes complicated, but also it has been found that the thickness of the tubes is often excessive or irregular, and therefore the volumetric ratio or proportion of the core material to the entire article is disproportionately low. For example, if attempts are made to make the radial thickness of the metal tubes below approximately 0.25 mm with current technology then the edges of the tubes generally fail to remain in abutment and this allows powder to fall out. On the other hand, if the tube edges are overlapped, when the rod is inserted into a molten bath the melting rate around its periphery is unequal. Because of the relatively poor dissolution or melting rate of the relatively thick prior art tubes, the rate of feeding them into the molten bath has necessarily been reduced in order to prevent the unmelted and excessively stiff remaining portions of the tubes from penetrating the sides of the casting mold's downsprue.

In view of the above, it would be advantageous to replace the relatively thick and non-uniform prior art tubes with a thinner casing, and yet retain a relatively high degree of uniformly dense fill material within the core.

SUMMARY OF THE INVENTION

The present invention is directed to overcoming one or more of the problems as set forth above.

According to the present invention, this is accomplished by extruding a treating material to form an elongated core element and by wrapping the extruding core element in a protective casing to form a filled tubular article. Advantageously, the core element is of uniformly consolidated density and the casing is thin so that the article is flexible and the casing will experience a relatively rapid rate of dissolution in the molten bath. Furthermore, the instant invention will provide increased core volume per unit length.

DETAILED DESCRIPTION OF THE INVENTION

Figure 1:
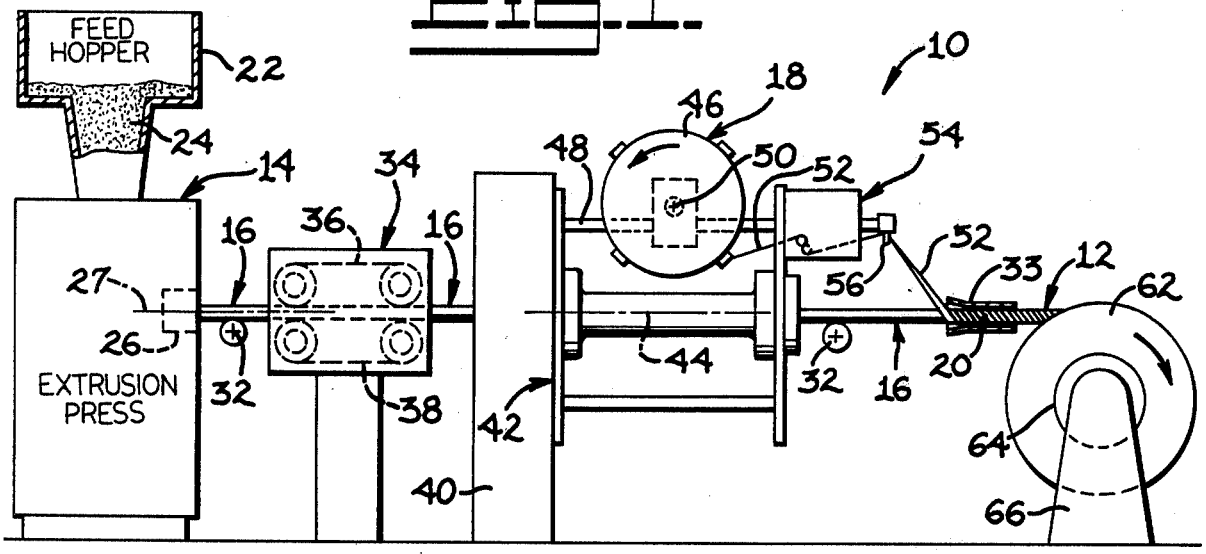
FIG. 1 is a diagrammatic side elevational view of a manufacturing facility illustrative of the method of making the filled tubular article in accordance with the present invention.
Figure 2:
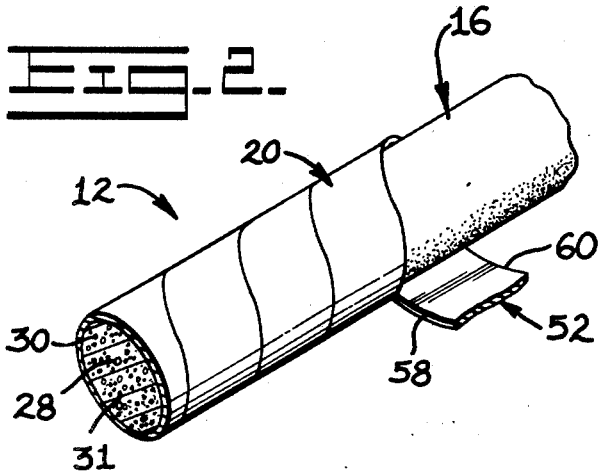
FIG. 2 is a diagrammatic and enlarged fragmentary view of a filled tubular article made by the manufacturing facility of FIG. 1.

Referring to FIG. 1, a manufacturing facility 10 is shown for making an improved filled tubular article 12 in accordance with the present invention. In its simplest form, the maufacturing facility contemplates use of an extruding apparatus or press 14 for making an elongated core element 16, and use of a rotatable wrapping device 18 for applying a helically wrapped casing 20 encirclingly about the core element. The exemplary tubular article thus produced is shown in FIG. 2.

More particularly, the extruding apparatus 14 preferably includes a feed hopper 22 in which a substantially homogeneous mixture of a treating material 24 has been placed. Through gravity, the treating material travels downwardly to be received within the internal mechanism of the extruding apparatus or press. As is well known, however, such presses are constructed so as to extrude the treating material 24 under considerable pressure, and often while simultaneously heating the treating material, through an outlet die 26 having a horizontal axis 27 and a suitable orifice of preselected dimensions concentrically disposed on the axis, not shown. Preferably, the core element 16 extends axially from the orifice of the die in the form of a continuously elongating cylindrical rod.

It should be appreciated that the core element 16 is normally in a "green" state after passing axially outwardly of the die, or to the right when viewing the drawing, and is generally capable of experiencing only a relatively limited amount of flexing without cracking. It is contemplated that the extruded core element includes a relatively compacted mixture of a particulate treating agent or plurality of inoculating elements 28 and a suitable binding or bonding agent 30 as generally indicated in FIG. 2, and may include other additives as well.

The term "treating agent" as used herein includes the element or elements which actually alter the molten metal so that upon cooling and hardening thereof into an article, the articles metallurgical structure has the desired modified physical properties. The type of treating agent 28 utilized is dependent upon the base composition of the molten metal to be treated and upon the desired metallurgical characteristics of the article. For example, for treating iron, the treating agent consists essentially of a plurality of ferrosilicon based particles capable of passing through a fine mesh sieve such as between Standard Test Sieve Nos. 30 to 140 (0.6 mm–0.1 mm nominal diameter of the openings). Three examples of such treating agents for iron are set forth below in percentage by weight:

| Example 1 | Example 2 | Example 3 |
|---|---|---|
| Si 74–79% | Si 60–65% | Si 44–48% |
| Al 1.00–1.5% | Mn 5–7% | Mg 8–10% |
| Ca 0.50–1.00% | Zn 5–7% | Fe balance |
| Fe balance | Ba 2–3% | |
| | Ca 1.5–2.5% | |
| | Al 0.75–1.25% | |
| | Fe balance | |

Example 1 above is identified as "Grade 75% ferrosilicon", Example 2 is identified as "SMZ Alloy" and Example 3 is identified as "9% magnesium ferrosilicon", all of which are manufactured by Union Carbide Corporation, Ferro-Alloys Division, Buffalo, New York.

As noted in the above examples, the treating agents 28 normally contain small portions of one or more additional elements in addition to the ferrosilicon constituent such as aluminum, calcium, manganese, zirconium, barium, magnesium, strontium, cerium, and the rare earth elements.

The term "binding agent" as used herein includes the resinous or cementlike material that is used to hold the particles of the treating agent together. Preferably, the binding agent 30 is selected from the group consisting of beeswax, sodium silicate, resin, casein, and organic plastic material including polyurethane. The amount of binding agent is preferably limited to a preselected range of from about 1 to not more than 10% of the weight of the core element 16. Enough binding agent is needed to allow proper extrusion of the core element and to maintain its shape. Too much binding agent, for example above 10%, will form a slug or will alternately lead to other problems such as producing an excessive amount of flames and bubbling reaction as the filled tubular article 12 is inserted into molten iron.

In addition to the treating agent 28 and the binding agent 30, it is contemplated that a lubricating or slipping agent 31 may be advantageous in forming the core element 16. Particularly, a relatively low proportion of a lubricating agent such as graphite or zinc stearate may be helpful during the extrusion of the mixture 24 through the die 26. However, it should be understood that the treating agent preferably makes up about 90% or more of the total weight of the treating material making up the core element, the binding agent makes up about 1 to not more than 10% of the weight of the core element, and the lubricating agent makes up about 0.3% to 2% of the weight of the core element.

It is contemplated that the core element 16 is compacted to a relatively dense state by the extrusion press 14, and experiences minimal swelling after passing axially outwardly of the die 26. For example, the density of the consolidated core element is preferably in a preselected range of about 85% to 95% theoretical density, which is substantially equivalent to having only about 5% to 15% volume in voids.

Despite the substantial consolidation of the extruded core element 16, it is to be appreciated that it is advantageous to continue its rightward movement along the axis 27 with but minor angular deviation to avoid abrupt flexing of the core element prior to the encasement thereof. Consequently, one or more support rollers 32 and one or more stationary guiding members 33 are preferably utilized for this purpose. Preferably also, a combined traction and support means 34 is located downstream of the extrusion press 14 to bias or urge the core element to the right when viewing the drawing. A pair of powered endless belts 36 and 38 disposed immediately above and below the core element may be used for this purpose.

Referring now to the wrapping device 18, it includes a support stand 40 and a rotary mechanism 42 which is controllable revolved about a central horizontal axis 44. Preferably, the axis 44 is in substantial alignment with the axis 27. At least one cylindrical reel 46 is located on a frame member 48 of the mechanism, which reel is generally revolvable in use in a counterclockwise direction when viewing the drawing about an axis 50. A ribbon-like strip 52 extends substantially axially from its stored position on the reel and to a tension monitoring unit 54. From there the strip extends through a guide 56 and obliquely onto the elongating core element 16.

Preferably, the ribbon-like strip 52 is relatively thin; for example, within a range of about 0.025 mm to 0.15 mm and preferably about 0.1 mm thick, and is helically wrapped about the core element 16 with its opposite side edges 58 and 60 disposed in aligned axial abutment with the facing side edges of the adjacent loop as shown in FIG. 2. It is contemplated that the strip is preferably a metal foil selected from the group consisting of a ferrous metal such as steel, aluminum, titanium, copper, and alloys thereof. However, it is to be appreciated that a strip of organic material such as of plastic or fibrous paper composition may be substituted for such metal foil without departing from the spirit of the present invention.

After the strip 52 is helically wound about the core element 16, the filled tubular article 12 is urged rightwardly by a powerably rotated cylindrical take-up reel 62 and an associated drive motor 64. The improved filled tubular article produced in this manner and wound on the reel, which is releasable from the motor and a support stand 66, is subsequently controllably inserted into molten metal for altering the metallurgical structure of the melt upon cooling and hardening thereof in a casting mold. Such a procedure is disclosed, for example, in more detail in U.S. Pat. No. 3,991,808 issued to John R. Nieman, et al on Nov. 16, 1976.

Figure 3:
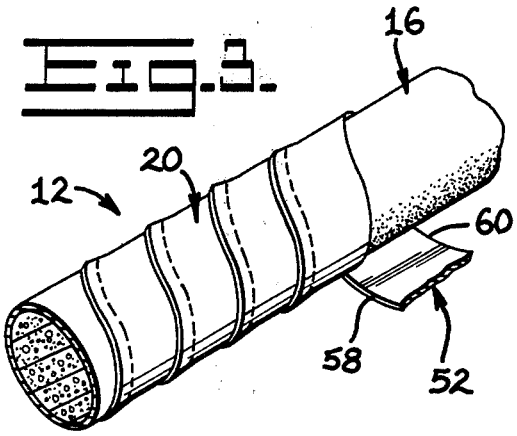
FIG. 3 is a view similar to FIG. 2, only showing an alternate embodiment filled tubular article with an overlapped form of exterior casing.

Referring to FIG. 3, an alternate embodiment is shown wherein the various elements of the filled tubular article 12 are the same and, accordingly, similar reference numerals have been applied thereto. However, in the alternate embodiment, the ribbon-like strip 52 has been wound about the core element 16 by the manufacturing facility 10 in such a way that the edges 58 and 60 axially overlap and provide more positive assurance of retention of any inadvertently loose particles of the core element 16. While this provides the disadvantage of a double thickness of the adjacent loops of the strip at the point of overlap, it is to be recognized that such double thickness is still about 30% or more less than the total thickness of the thinnest practical prior art casing.

Figure 4:
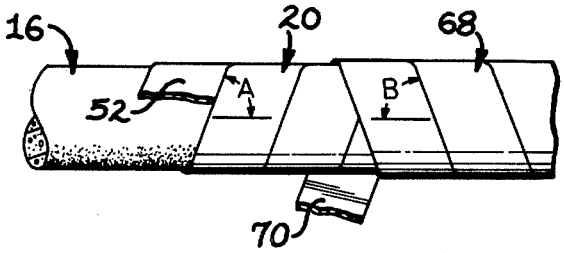
FIG. 4 is an enlarged and fragmentary diagrammatic side elevational view of a second alternate embodiment filled tubular article showing two layers of exterior casing.

A more sophisticated embodiment is shown in FIG. 4, wherein the core element 16 and casing 20 are substantially as described above with reference to FIG. 2. However, in this example a second layer or casing 68 has been applied over the casing 20. The second casing includes a second continuous ribbon-like strip 70 which is advantageously oriented at a different angle of orientation than the first strip 52 relative to the core element as indicated generally on the drawing by the reference letters A and B. Preferably, the first and second strips are sequentially and helically wound about the core element from opposite directions as is clearly shown. The dual layer casing is stronger and has a reduced tendency to unwind. Specifically, a single helically wound strip has a tendency to exhibit a resistance to coiling and a tendency to open up between adjacent loops if forcibly coiled incorrectly. Another wrapping device 18, not shown, would be required to provide the second layer of casing in any continuous extension of the manufacturing facility 10. Such second wrapping device would be located axially intermediate the first wrapping device and the take-up reel 62.

In view of the foregoing, it is readily apparent that the method of the present invention provides an improved filled tubular article useful for controlled insertion into a molten metal. Rather than simply filling a tube with loose particulate material as has been done in the past, the manufacturing facility 10 contemplates the following sequential procedure:

Step (a) mixing a particulate treating agent and a binding agent to form a treating material.

Step (b) feeding the treating material to an extruding apparatus;

Step (c) extruding the treating material, optionally in the presence of heat, through a die to form an elongated core element;

Step (d) wrapping the extruding core element in a protective casing; and

Step (e) rolling up the encased core onto a takeup reel.

Moreover, the above described procedure may be extended to helically wrapping the core element in various ways, including helically wrapping a second layer onto a first layer by an additional wrapping step. Still further, the instant manufacturing facility is easily adapted to overlappingly winding one ribbon-like strip or a plurality of such strips about the core element.

Other aspects, objects and advantages will become apparent from a study of the specification, drawings and appended claims.

The embodiments of the invention in which an exclusive property or privilege is claimed are defined as follows:

1. A filled tubular inoculation rod (12) for controlled insertion into a molten metal for altering same, comprising:

an extruded elongated core element means (16) for treating the molten metal, said core element means (16) including a particulate mixture of a treating agent (28) and a binding agent (30) consolidated in a preselected range of about 85% to 95% theoretical density, said treating agent (28) comprising about 90% or more of the total weight of said core element means (16) and said binding agent (30) comprising about 1% to not more than 10% of the total weight of said core element means (16); and casing means (20) for substantially covering the entire exterior surface of said core element means (16) and containing said core element means (16), said casing means (20) being intimately and helically wrapped about said core element means (16).

2. The article (12) of claim 1 wherein said binding agent (30) is selected from the group consisting of beeswax, sodium silicate, resin, casein, and organic plastic material including polyurethane.

3. The article (12) of claim 1 wherein said casing means (20) includes a ribbon-like strip (52) of metal selected from the group consisting of a ferrous metal, aluminum, titanium, copper, and alloys thereof.

4. The article (12) of claim 1 wherein said core element means (16) further includes a lubricating agent (31) comprising about 0.3% to 2% of the total weight of said core element means (16).

5. The article (12) of claim 4 wherein said lubricating agent (31) is zinc stearate.

6. A method of making a filled tubular inoculation rod (12) for controlled insertion into a molten metal for altering same, comprising:

Step (a) mixing a particulate treating agent (28) and a binding agent (30) and forming a treating material (24);

Step (b) extruding the treating material (24) from an extruding apparatus (14) and forming a continuously elongating core element (16); and Step (c) helically wrapping said elongating core element (16) in a protective casing as the core element (16) extends from the extruding apparatus (14).

7. The method of claim 1 wherein Step (a) includes mixing a lubricating agent (31) with the particulate treating agent (28) and the binding agent (30) and forming said treating material (24) to promote extrusion of the treating material (24) in Step (b).

8. The method of claim 1 wherein Step (c) includes helically wrapping the elongating core element (16) by a rotatable wrapping device (18); and including supporting and guiding said elongating core element (16) between the extruding apparatus (14) and the wrapping device (18).

9. The method of claim 1 including heating the treating material (24) prior to Step (b).

* * * * *